United States Patent [19]

Davis et al.

[11] Patent Number: 4,960,387

[45] Date of Patent: Oct. 2, 1990

[54] PIN SAVER

[75] Inventors: Wayne S. Davis, Harrisburg; Charles E. Reynolds, Mechanicsburg; Robert N. Whiteman, Jr., Middletown, all of Pa.

[73] Assignee: AMP Incorporated, Harrisburg, Pa.

[21] Appl. No.: 494,783

[22] Filed: Mar. 12, 1990

Related U.S. Application Data

[63] Continuation of Ser. No. 303,108, Jan. 25, 1989, abandoned, which is a continuation of Ser. No. 90,295, Aug. 31, 1987, abandoned.

[51] Int. Cl.[5] ..... H01R 13/629

[52] U.S. Cl. ..... 439/374

[58] Field of Search ..... 439/526, 374–377

[56] References Cited

U.S. PATENT DOCUMENTS

| | | | |
|---|---|---|---|
| D. 271,685 | 12/1983 | Casciotti et al. | D13/24 |
| D. 271,686 | 12/1983 | Casciotti et al. | D13/24 |
| 3,215,975 | 11/1961 | Kinkaid | 439/850 |
| 3,588,784 | 1/1969 | Kunkle et al. | 439/379 |
| 3,685,001 | 8/1972 | Krafthefer | 439/377 |
| 4,448,471 | 5/1984 | Berry et al. | 439/451 |

FOREIGN PATENT DOCUMENTS 3602296 7/1987 Fed. Rep. of Germany .

OTHER PUBLICATIONS

AMP Data Sheet 74–266, Revised 7/83.

*Primary Examiner*—Gary F. Paumen
*Attorney, Agent, or Firm*—David L. Smith

[57] ABSTRACT

An electrical connector assembly comprising a pair of complementary connectors (10*a*, 12) incorporating "pin saver" structure for preventing pin contacts (16) from being bent when the connectors (10*a*, 12) are mated or separated in a careless fashion. The "pin saver" structure comprises a plurality of projections or ledges (42, 43, 44, 45) on one of the connectors (10*a*) for defining extended fulcrums around which the other connector (12) will rotate or turn if the connectors (10*a*, 12) are mated or separated from one another by relative movement in which the longitudinal axes (31) of the pin contacts (16) in one connector are not maintained substantially parallel to the longitudinal axes (32) of the receptacle contacts (14) in the other connector (10*a*) during mating or separation. The extended fulcrums cause the pin contacts (16) to be inserted into or withdrawn from the receptacle contacts (14) in directions such that the longitudinal axes (32, 31) of the contacts are maintained more nearly parallel to one another until the pin contacts (16) are substantially fully inserted into or fully withdrawn from the receptacle contacts (14) during mating or separation, respectively, to prevent the pin contacts (16) from being pressed against the sidewalls of the receptacle contacts (14) and bent or otherwise damaged during mating or separation of the connectors (10*a*, 12).

7 Claims, 2 Drawing Sheets

PIN SAVER

This application is a Continuation of application Ser. No. 07/303,108 filed Jan. 25, 1989, now abandoned, which is a Continuation of application Ser. No. 090,295 filed Aug. 31, 1987, now abandoned.

FIELD OF THE INVENTION

The present invention relates generally to electrical connectors and, more particularly, to "pin saver" structure for preventing damage to the pin contacts of an electrical connector during mating with or separation from a complementary connector.

BACKGROUND OF THE INVENTION

Electrical connectors are frequently used in applications which require that connectors be periodically mated or separated from one another. Often, these operations are performed in a rather careless fashion. For example, it is not uncommon for a hurried or careless person to separate a pair of connectors by simply yanking at the cable to which one of the connectors is attached, and thereby apply tension having a nonaxial force component tending to impart a torque on the connector assembly during separation.

A connector assembly typically comprises a receptacle connector having one or more receptacle contacts and a plug connector having one or more pin contacts which are designed to extend into the receptacle contacts when the connectors are mated, and to be withdrawn from the receptacle contacts when the connectors are separated. The connectors are adapted to be mated and separated by relative movement of the connectors toward and away from one another in directions substantially parallel to the longitudinal axes of the receptacle and pin contacts. If the connectors are mated or separated carelessly, however, one or both of the connectors can turn or rotate relative to the other connector causing the pin contacts to press against the sidewalls of the receptacle contacts and be bent out of shape, thus damaging the plug connector and rendering the connector assembly incapable of being properly mated thereafter. The pin contacts are particularly susceptible of being bent during separation of the connectors, and the problem is especially acute when the connectors are small in size and contain a plurality of contacts, as the pin contacts are also small and rather fragile.

To help protect pin contacts during mating or separation of a pair of connectors, it is known to design the connectors such that the pin contacts are recessed within their connector. Such connectors, however, tend to be rather complex in design and more costly to manufacture, and are not always effective in preventing damage to the pin contacts.

SUMMARY OF THE INVENTION

The present invention relates to an electrical connector assembly comprising a pair of complementary connectors in which at least one connector of the assembly includes "pin saver" structure for preventing pin contacts from being bent or otherwise damaged when the connectors are mated and, particularly, when they are separated in a careless fashion. The connector assembly according to the invention comprises a first connector having one or more receptacle contacts exposed along the forward connector face; and a second connector having one or more pin contacts exposed along the forward connector face, the one or more pin contacts being adapted to extend longitudinally into or be longitudinally withdrawn from the one or more receptacle contacts when the connectors are mated or separated, respectively, by relative movement of the connectors toward or away from one another, respectively, with the longitudinal axes of the receptacle and pin contacts maintained substantially parallel to one another, the connector assembly including structure defining a first fulcrum about which relative rotation of the connectors will normally occur if the connectors are mated or separated by relative movement in which the longitudinal axes of the receptacle and pin contacts are not maintained substantially parallel to one another, the first fulcrum defining structure defining a first curved path having a first radius of curvature along which the connectors are capable of moving relative to one another when the connectors are mated or separated; the improvement comprising: means on at least one of said connectors defining a second, extended fulcrum about which relative rotation will occur if the connectors are mated or separated by relative movement in which the longitudinal axes of the receptacle and pin contacts are not maintained substantially parallel to one another, the second, extended fulcrum being positioned laterally outwardly on said at least one connector relative to said first fulcrum for defining a second curved path having a second radius of curvature along which the connectors are capable of moving relative to one another when the connectors are mated or separated which is longer than the first radius of curvature whereby the longitudinal axes of the contacts are maintained more nearly parallel to one another by the second, extended fulcrum than would be maintained by the first fulcrum until the one or more pin contacts are substantially fully inserted into or fully withdrawn from the one or more receptacle contacts during mating or separating, respectively, of the connectors.

According to the invention, the means for defining a second, extended fulcrum comprises a projection on at least one of the connectors for defining an extended fulcrum around which the other connector will rotate if the connectors are mated or separated unevenly. Because the second, extended fulcrum is positioned laterally outwardly on the connector relative to the first fulcrum, the second, extended fulcrum defines a curved path about which the other connector is capable of turning or rotating which has a radius of curvature which is longer than the radius of curvature defined by the first fulcrum. The increased radius permits the one or more pin contacts to be fully inserted into or fully withdrawn from the one or more receptacle contacts in directions more parallel to the longitudinal axes of the contacts such that the pin contacts will not be pressed against the sidewalls of the receptacle contacts and bent during mating or separation of the connectors.

According to a presently preferred embodiment of the invention, the first and second connectors include first and second surfaces which are adapted to face one another when the connectors are mated; and the means for defining a second, extended fulcrum comprises ledges extending upwardly from opposite sides of one of the surfaces. In a presently most preferred embodiment, the first and second surfaces are of generally rectangular shape; and the ledges comprise four ledges positioned adjacent each of the four corners of one of the surfaces so as to maximize the radii of curvature defined by the second, extended fulcrums about which the connectors are capable of rotating during mating or separation to, in turn, maximize the distance by which the pin contacts can be inserted into or withdrawn from the receptacle contacts without pressing against the sidewalls of the receptacle contacts.

The "pin saver" of the present invention is highly effective in preventing pin contacts from being bent when a pair of connectors is carelessly mated or separated, and is relatively simple in design and does not significantly increase the cost of the connector.

Further advantages and specific features of the invention will become apparent hereinafter in conjunction with the following detailed description of a presently preferred embodiment.

DETAILED DESCRIPTION OF THE PREFERRED EMBODIMENT

Figure 1:
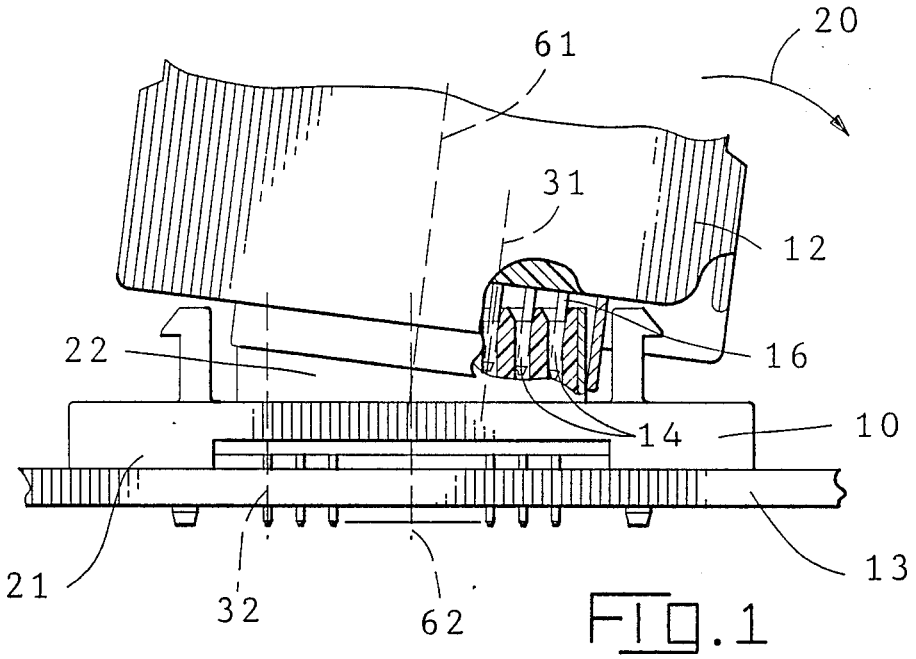
FIG. 1 PRIOR ART
FIG. 1 illustrates a pair of complementary connectors which do not incorporate "pin saver" structure of the present invention in the process of being separated, and partly broken away in order to help explain the invention.
Figure 2:
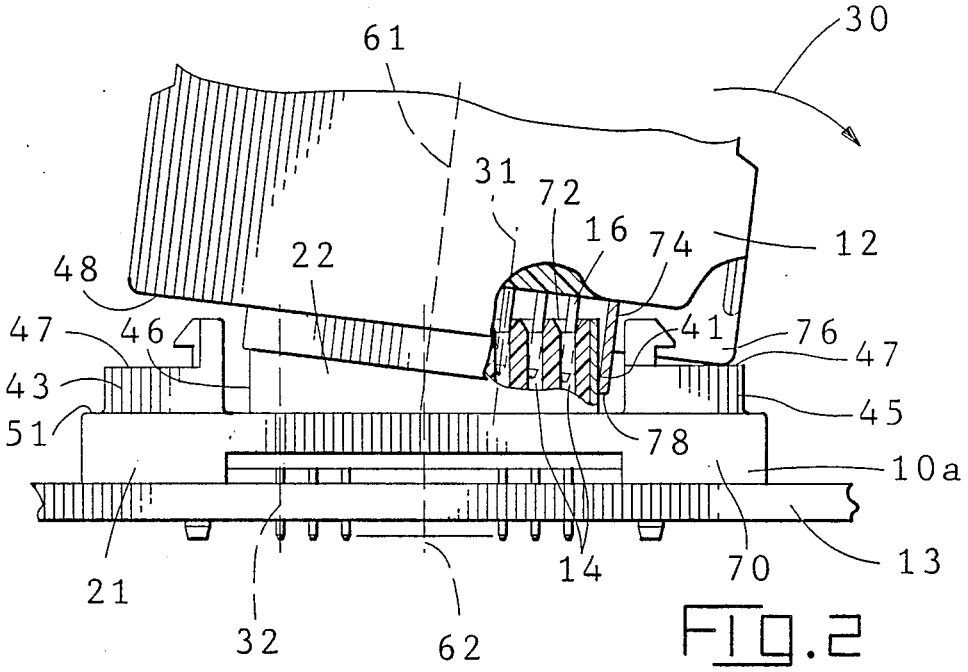
FIG. 2 illustrates a pair of complementary connectors which incorporates "pin saver" structure according to a presently preferred embodiment of the invention in the process of being separated partially broken away similarly to FIG. 1.

FIGS. 1 and 2 illustrate a pair of complementary electrical connectors in the process of being separated from one another. FIG. 1 illustrates a receptacle connector 10 which does does not include "pin saver" structure according to the present invention, and accordingly, is identified in the drawings as "prior art". It should be understood, however, that the connector of FIG. 1 is identified as prior art only to the extent that it does not include pin saver structure according to the present invention, and is not to be considered as prior art for any other purpose. FIG. 2 illustrates a receptacle connector 10*a* which does incorporate the "pin saver" structure of the invention. Both FIGS. 1 and 2 illustrate an identical laterally elongate plug connector 12 which is complementary to both laterally elongate receptacle connectors 10 and 10*a*.

Receptacle connectors 10 and 10*a* are identical except for the inclusion of "pin saver" structure on connector 10*a* and comprise high-density connectors containing two rows of receptacle contacts 14. Connectors 10 and 10*a* are also adapted to be mounted to a printed circuit board or other panel designated by reference numeral 13. Plug connector 12 includes two rows of pin contacts 16 and can, for example, comprise a cable-terminating connector.

Figure 3:
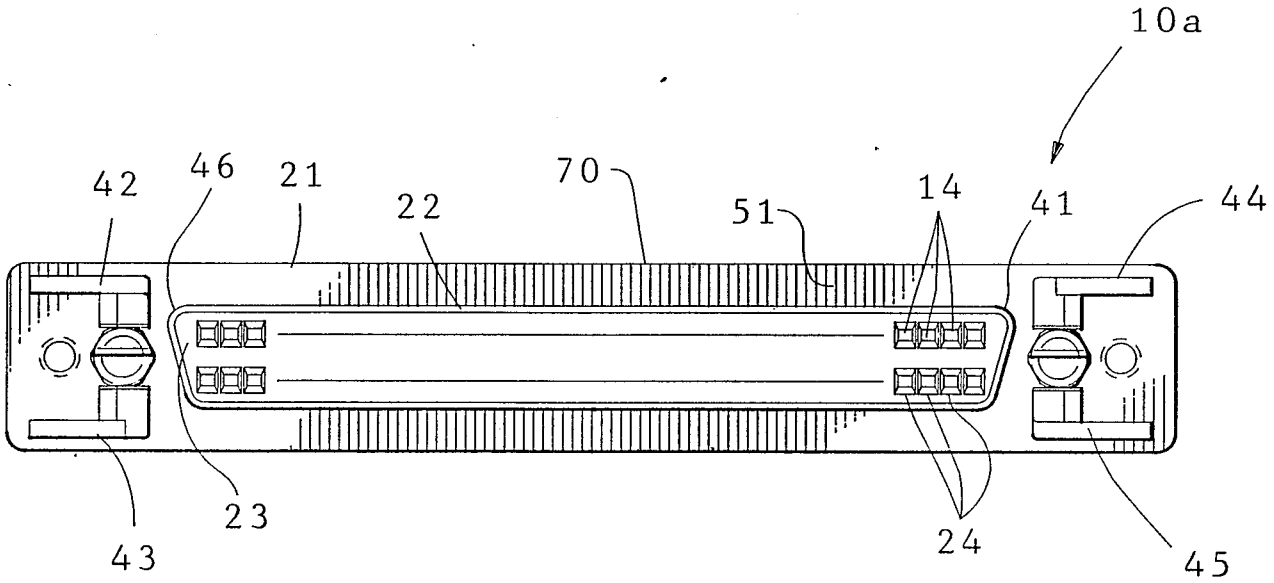
FIG. 3 is a top view of the receptacle connector of FIG. 2.

Receptacle connectors 10 and 10*a* (receptacle connector 10*a* is also illustrated in FIG. 3) include a housing 21, a metal shroud 22 and a header or plug portion 23 of plastic insulating material. Header 23 has a plurality of passageways 24 extending therethrough for receiving receptacle contacts 14 and is supported within shroud 22. Shroud 22 is, in turn, supported within a D-shaped polarizing aperture in housing 21 to form the connector. Shroud 22 and header 23 extend relatively upwardly of forwardly facing surface 51 of a flange 70 of housing 21 to a mating face 72 along which are defined the entrances to the passageways 24.

Mating connector 12 includes a shroud 74 extending relatively downwardly of forwardly facing surface 48 of peripherally surrounding wall 76 to a leading edge 78, to protect the pin contacts 16.

As known to those skilled in the art, complementary connector pairs 10 and 12 and 10*a* and 12 are adapted to be mated by moving connector 12 toward connector 10 or 10*a* in an orientation such that the longitudinal axes 31 and 32 of the pin and receptacle contacts, respectively, are maintained substantially parallel to one another until pin contacts 16 extend fully into receptacle contacts 14. Similarly, the connectors are adapted to be separated from one another by moving connector 12 away from connector 10 or 10*a* while maintaining the longitudinal axes 31 and 32 of the contacts substantially parallel to one another until pin contacts 16 are fully withdrawn from receptacle contacts 14 along the mating face of connector 10 or 10*a*. Frequently, however, connectors are mated or separated rather carelessly, and under such circumstances, connector 12 can be rotated or turned relative to connector 10 or 10*a* as it is being mated or separated from connector 10 or 10*a* such that the longitudinal axes of the pin and receptacle contacts are not maintained parallel to one another. When this occurs, the pin contacts tend to be pressed against the sidewalls of the receptacle contacts and can be easily bent or otherwise damaged.

FIG. 1 illustrates connector 12 in the process of being separated from connector 10 in a manner such that the longitudinal axes of contacts 14 and 16 are not maintained substantially parallel to each other. (The following discussion refers primarily to separation of the connectors; however, it should be understood that the invention is similarly effective in protecting the pin contacts during mating of the connectors.) In effect, connector 12 has been turned or rotated relative to connector 10 in the direction indicated by arrow 20 about a fulcrum which, due to the inherent design of the connectors, is at a point along the laterally outermost portion 41 (see FIG. 3) of shroud 22. Because of the rotation of connector 12 relative to connector 10, pin contacts 16 also turn relative to receptacle contacts 14 and are pressed against the sidewall of receptacle contacts 14 as they are withdrawn therefrom. As a result, pin contacts 16 can be easily bent as the connectors are separated as is shown in FIG. 1.

It should be understood, that connector 10 also defines a fulcrum at position 46 on the opposite side of shroud 22 around which connector 12 will rotate if it turned in the opposite direction during separation of the connectors.

FIG. 2 illustrates connector 12 in the process of being separated from receptacle connector 10*a* which incorporates "pin saver" structure according to the present invention for preventing damage to the pin contacts 16 during mating or separation of the connectors 10*a* and 12. The pin saver structure comprises a plurality of four projections 42, 43, 44, and 45 mounted on and extending upwardly from forwardly facing surface 51 of housing 21 adjacent the four corners of the generally rectangular-shaped housing. The projections comprise transverse edges of generally rectangular-shape and are preferably of a height such that top surfaces 47 thereof will just engage portions of forwardly facing surface 48 of plug connector 12 when the connectors are mated.

As shown in FIG. 2, if during separation of connectors 10a and 12, connector 12 is moved away from connector 10a in such a manner that the longitudinal axes 31 and 32 of the pin and receptacle contacts are not maintained substantially parallel to one another, i.e., such that connector 12 is rotated or turned relative to connector 10a during separation in the direction indicated by arrow 30 in FIG. 2, a portion of forwardly facing surface 48 on connector 12 will contact the upper surface 47 of ledges 44 and 45 and be rotated about ledges 44 and 45. Ledges 44 and 45 thus define a second, extended fulcrum, which will act as the primary fulcrum around which connector 12 will turn during careless separation of the connectors.

As should be apparent in FIG. 2, the second, extended fulcrum defined by top surfaces 47 of ledges 44 and 45 is positioned outwardly of the fulcrum at position 41 relative to the central axes 62 and 61 of connectors 10a and 12. Top surfaces 47 are also defined forwardly of forwardly facing surface 51 but rearwardly of the mating face of connector 10a. As a result, the curved path about which connector 12 will rotate or turn during separation of the connectors has a longer radius of curvature than the radius of curvature of the curved path defined by the fulcrum at position 41 and which will rotate or turn about a point along top surface 47 which is closer to the mating face than the fulcrum defined at position 41. Therefore, the pin contacts 16 will withdraw from receptacle contacts 14 of connector 10a without being pressed against the sidewalls of the receptacle contacts to any significant extent, if at all, and without being bent thereby. In other words, by moving the fulcrum about which connector 12 is able to turn relative to connector 10a a greater distance from the central axis of connector 10a relative to the fulcrum defined at position 41 and axially forwardly thereof, the pin contacts 16 withdraw from receptacle contacts 14 in a direction such that the longitudinal axes of the contacts are maintained more nearly parallel to one another than if the fulcrum were at position 41. Accordingly, the pin contacts are able to be fully withdrawn from the receptacle contacts without pressing against the sidewalls of the receptacle contacts and without being bent thereby.

Ledges 42 and 43 on the opposite side of connector 10a from ledges 44 and 45 define second, extended fulcrums when the connector 12 is turned in the opposite direction from arrow 30 during separation of the connectors. Ledges 42–45 are preferably positioned on connector 10a as far from the central axis of the connector as the design of the connector assembly will permit so as to maximize the length of the axis of rotation of the connectors about the second, extended fulcrum.

Although in the embodiments described herein, ledges 42–45 are on receptacle connector 10a, the ledges could alternatively be provided to extend downwardly of forwardly facing surface 48 of plug connector 12. Also, shorter ledges can be provided on both connectors, if desired. It should also be emphasized that connector 10a does not need to be mounted to a printed circuit board or otherwise maintained stationary. Either or both connectors can be movable relative to the other connector during mating and separation of the connectors and obtain the benefits of the "pin saver" structure of the invention.

Because the present invention can take numerous forms, it should be understood that the invention should be limited only insofar as is required by the scope of the following claims.

We claim:

1. In an electrical connector assembly comprising:

a first laterally elongate connector having one or more receptacle contacts exposed along a mating face of a plug portion thereof, and further having a flange peripherally surrounding said plug portion and including a peripherally surrounding forwardly facing surface rearward of said mating face; and a second laterally elongate connector having one or more pin contacts extending forwardly of a forward face thereof, said one of more pin contacts being adapted to be received within said one or more receptacle contacts when said connectors are mated, and said second connector including a shroud surrounding said pin contacts adapted to receive thereinto said plug portion of said first connector and a wall peripherally surrounding said shroud and defining a peripherally surrounding forwardly facing surface rearward of the leading edge of said shroud; the improvement comprising:

at least one projection extending forwardly from said forwardly facing surface of at least one of said connectors and laterally outwardly of each end of said shroud when said connectors are mated, said projection including a transverse surface positioned forwardly of said peripherally surrounding surface and facing the other of said connectors and adjacent a corresponding portion of said other connector whereby if the connectors are mated or unmated in a manner tending to rotate the connectors relatively about an end of the assembly, the transverse surface of the at least one projection at that end of the assembly defines a primary fulcrum when engaged by the corresponding adjacent portion of the other connector tending to maintain the longitudinal axes of the contacts nearly parallel to one another without using vertical guide means until said pin contacts are substantially fully mated within or fully withdrawn from said receptacle contacts and thereby minimizing stress and resultant damage to the contacts and the connectors.

2. The connector assembly of claim 1 wherein said at least one projection comprises respective projections extending from adjacent opposite sides forwardly from said forwardly facing surface of said at least one connector.

3. The connector assembly of claim 2 wherein said projections comprise elongated transverse ledges.

4. The connector assembly of claim 3 wherein said forwardly facing surfaces of said connectors are generally rectangular in shape, and wherein said ledges are positioned adjacent the four corners of one of said surfaces.

5. An electrical connector assembly, comprising:

a first, laterally elongate board-mounted connector having a plurality of receptacle contacts exposed along a mating face of a plug portion thereof, said first connector having a flange peripherally surrounding said plug portion defining a forwardly facing surface rearward of said mating face;

a second laterally elongate connector having a plurality of pin contacts being adapted to be received within said plurality of receptacle contacts when said connectors are mated, said plurality of pin contacts extending forwardly within a protective shroud of said second connector, said shroud adapted to receive therein said plug portion of said first connector, said second connector including a flange peripherally surrounding said shroud, said flange defining a forwardly facing surface rearwardly of a leading edge of said shroud; and at least one projection on said first connector at each end of said shroud including a transverse surface facing said second connector and positioned forwardly of said peripheral flange and adjacent a corresponding portion of said second connector when said connectors are mated, whereby if the connectors are mated or unmated in a manner tending to rotate the connectors relatively about an end of the assembly, the forwardly facing surface of the at least one projection at that end of the assembly defines a primary fulcrum when engaged by the corresponding adjacent portion of the second connector tending to maintain the longitudinal axes of the contacts nearly parallel to one another without using vertical guide means until said pin contacts are substantially fully mated within or fully withdrawn from said receptacle contacts and thereby minimizing stress and resultant damage to the contacts and the connectors.

6. The connector assembly of claim 5 wherein said at least one projection comprises respective projections adjacent opposite sides of said forward surface of said first connector, forward facing portions of said projections being adapted to be engaged by corresponding portions of said forward surface of said second connector if the connectors are relatively rotated upon withdrawal.

7. The connector assembly of claim 6 wherein said surface of said first connector is of substantially rectangular shape and wherein said projections comprise transverse respective ledges positioned adjacent each of the four corners of said substantially rectangular-shaped surface.

* * * * *

UNITED STATES PATENT AND TRADEMARK OFFICE

CERTIFICATE OF CORRECTION

PATENT NO. : 4,960,387

DATED : October 2, 1990

INVENTOR(S) : Wayne S. Davis, et al

It is certified that error appears in the above-identified patent and that said Letters Patent is hereby corrected as shown below:

In the Claims:

Column 8, line 18, claim 7, The words "transverse respective" should be --respective transverse--.

Signed and Sealed this

Seventh Day of April, 1992

*Attest:*

HARRY F. MANBECK, JR.

*Attesting Officer*

*Commissioner of Patents and Trademarks*